United States Patent [19]

Murmann

[11] 4,339,643

[45] Jul. 13, 1982

[54] PUSH-BUTTON KEY SWITCH

[75] Inventor: Gunter Murmann, Bavaria, Fed. Rep. of Germany

[73] Assignee: Cherry Electrical Products Corporation, Waukegan, Ill.

[21] Appl. No.: 160,640

[22] Filed: Jun. 18, 1980

[30] Foreign Application Priority Data

Dec. 22, 1979 [DE] Fed. Rep. of Germany ..... 2952107

[51] Int. Cl.[3] ..... H01H 1/26; H01H 3/12

[52] U.S. Cl. ..... 200/159 A; 200/6 BB; 200/73; 200/153 LA; 200/283

[58] Field of Search ..... 200/676, 68, 73, 153 LA, 200/159 A, 283, 6 BB, 6 C

[56] References Cited

U.S. PATENT DOCUMENTS

| | | | |
|---|---|---|---|
| 2,714,638 | 8/1955 | Schmocker | 200/68 |
| 3,715,545 | 2/1973 | Long | 200/159 A |
| 3,764,762 | 10/1973 | Roeser | 200/68 |
| 3,924,090 | 12/1975 | Chao et al. | 200/153 LA |

*Primary Examiner*—John W. Shepperd

*Attorney, Agent, or Firm*—Hume, Clement, Brinks, Willian & Olds, Ltd.

[57] ABSTRACT

The invention relates to a push-button or key switch comprising at least one contact member stationary in a case and a switch blade whose contact tongue is resiliently pivotal from one switching position into another switching position by means of a key push member supported on a return spring.

11 Claims, 9 Drawing Figures

PUSH-BUTTON KEY SWITCH

SUMMARY OF THE INVENTION

Such key or push-button switches are generally known in a great variety of forms. For modern input keyboards of electronic systems, and in particular for writing keyboards of electronically controlled writing and printing systems, key switches of flat construction are required which with a very high life must firstly be extremely stable and adapted to be assembled completely automatically and secondly ensure a noticeable pressure point immediately before closure of the contact in the interest of a reliable switching function. It is essential that a differential path be ensured between the switching and return point, i.e., hysteresis behavior, and that the key switch can be made very economically as mass produced product.

This problem is solved according to the invention in that the contact tongue is also resiliently pivotal perpendicularly to the direction of the switching stroke and that the key cam comprises a driver nose which deflects the contact tongue on actuation of the key switch prior to the release of said tongue in the direction of the displacement of the key push member.

In a key switch made in accordance with the invention, the contact tongue of the blade is entrained on actuation of the push member by the driver nose in the direction of the movement of the push member until the contact tongue by its biasing force overcomes the frictional resistance of the cam, and moves automatically in an inclined upwards movement into the second contact position. When on actuation of the switch the contact tongue comes to bear on the driver nose, the desired clearly tactile pressure point is obtained by an increase of the actuating force immediately prior to the switching point, said force then dropping in the switching point and then increasing again linearly on further depression of the push member up to the end stop.

For blocking the deflection of the contact tongue in the direction of the returning push member, the contact tongue lies between two guide ribs extending parallel to the key push member, one guide rib comprising an upper stop shoulder preventing the deflection, and the other guide rib comprising a lower downwardly inclined stop shoulder permitting the deflection.

DESCRIPTION OF THE DRAWING

The advantages and features of the invention will be apparent from the following description of an example of embodiment in conjunction with the claims and drawings, wherein

GENERAL DESCRIPTION

Figure 1:
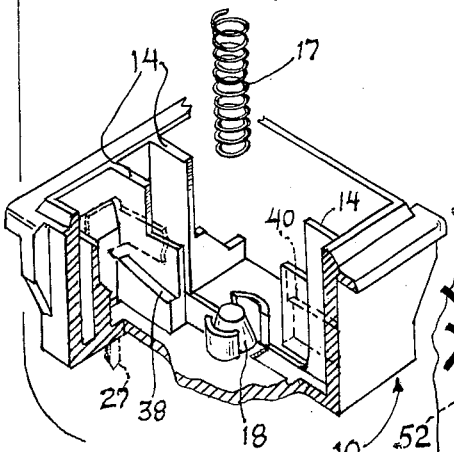
FIG. 1 is an exploded and partially sectioned view of the push button key switch according to this invention.
Figure 6:
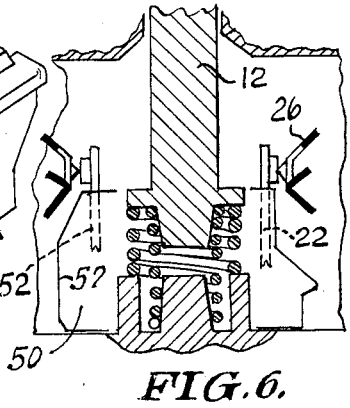

The key switch illustrated in exploded view in FIG. 1 comprises a case 10 which is closed with a cover 11. Disposed in the case 10 is a key push member 12 having at its lower end guide flanges 13 which engage between guide ribs 14, formed on the case to guide the push member during the switching stroke movement. In the lower central area, the push member is provided with a recess 15 in which at the upper end a retaining pin 16 is formed. Fitted on said retaining pin 16 is a coil pressure spring 17 which bears on the one hand on the key push member, and on the other hand on the bottom of the case. To avoid a lateral displacement, the coil pressure spring is fitted at the bottom of the case over a retaining pin 18.

Projecting downwardly from the push member 12 at the lower portion is a key cam 20 which carries at its lateral end face a driver nose 21. A further key cam is disposed on the back of the illustration of the push member diametrically opposite for actuation of the second contact pair. In the illustration, the latter key cam cannot be seen.

The contacts consist of a pair of contact members 22 stationary in the case, and a pair of blades 24. The contact members 22 are made rigid and disposed stationary in the case, bearing with their backs on the guide ribs 14. Each of the blades 24 comprises a vertically extending portion 25 and a horizontally extending contact tongue 26. Formed at the lower end of the vertically extending portion 25 is a soldering lug 27 which is also inserted through the bottom of the case. At the lower edge of the contact tongue 26 a notch 28 extending in the vertical portion of the contactor is formed and reduces the spring stiffness. At the front end of the contact tongue, a cam 32 and a contact 33 are provided.

The contactor bears with the straight portion of the contact tongue 26 on a guide rib 14 extending from the bottom of the case upwardly. A further guide rib 36 made integrally with the cover 11 projects from above into the case and engages over the horizontal portion 29 of the contact tongue 26 from the other side as seen in FIG. 2, so that the contact tongue 26 is secured against bending in the horizontally extending region.

The guide rib 36 is provided with a horizontally extending stop shoulder 37 which limits the movement of the contact tongue 26 upwardly. As shown in FIG. 1, a shoulder 38 is formed on the guide rib 14. This shoulder 38 inclines downwardly to permit the pivoting of the contact tongue downwardly, the latter bending in the region of the notch 28.

A second blade 24 is secured by a guide rib 39 originating from the cover 11 and the guide rib 14. However, both the guide rib 14 and the guide rib 39 have horizontally extending stop shoulders 40 and 41 and consequently pivoting of the contact tongue in the vertical direction is prevented. Finally, to increase the key pressure for continuous function, a further coil pressure spring 42 is provided which is placed over the coil pressure spring 17 and inserted into the recess 15. For biasing this spiral pressure spring 42 at the lower edge of the recess 15 on both sides of the key push member 12, a support shoulder 43 is formed on which the lower end of the coil pressure spring 42 bears in the tensioned condition. This produces a permanent biasing.

Figure 2:
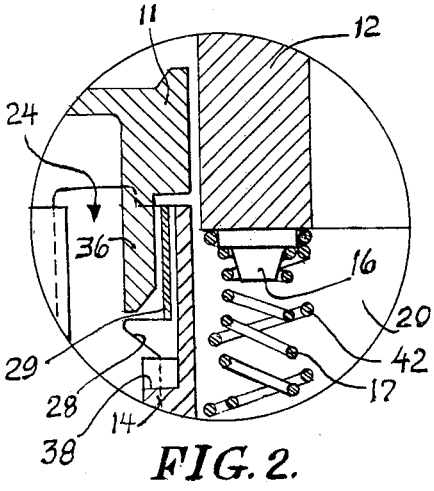
FIG. 2 is a enlarged partial detailed sectional view of an assembled part of the invention.

The arrangement of the two coil pressure springs 17 and 42 over each other is also shown in the illustration of FIG. 2 in which the horizontal portion of the contact tongue secured by the guide ribs is also visible.

To explain the mode of operation of both switch blades 24, attention is drawn to the illustrations of FIGS. 3 to 9.

Figure 3:
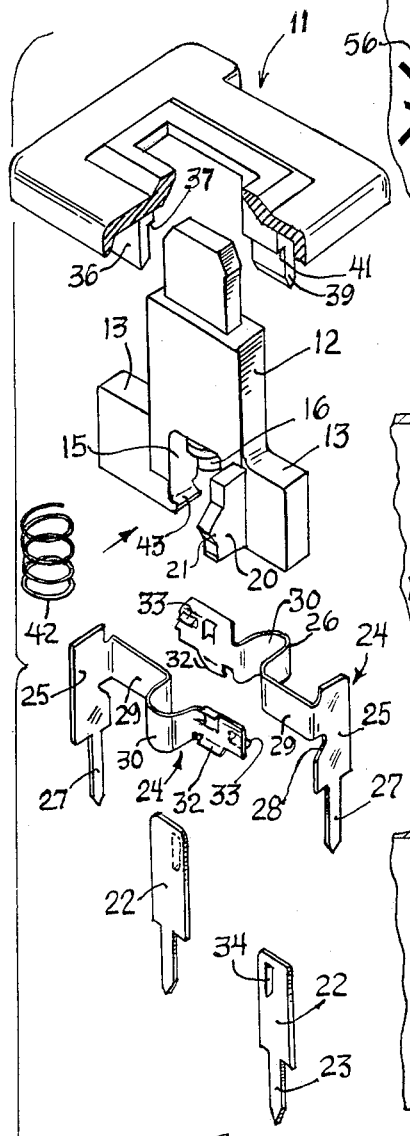
FIGS. 3 through 6 are a diagramatic sectional view of the push botton key switch disclosing the progressive steps of actuation.
Figure 3:
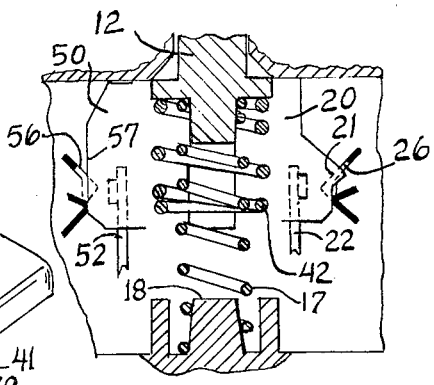
Figure 7:
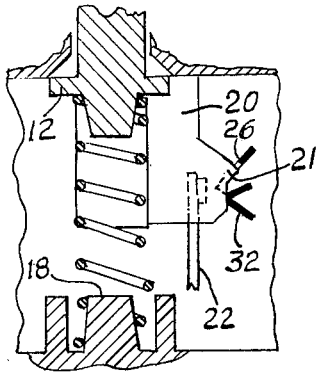
FIGS. 7 through 9 are diagramatic sectional detailed views of a single switch blade push botton key switch and its sequential operation.
Figure 4:
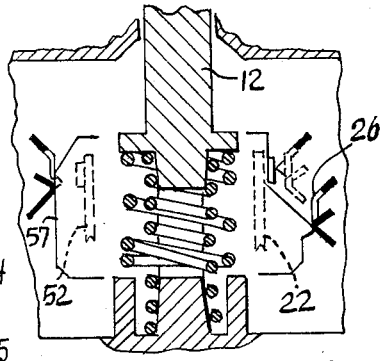
Figure 8:
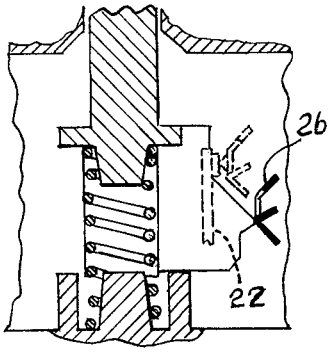
Figure 5:
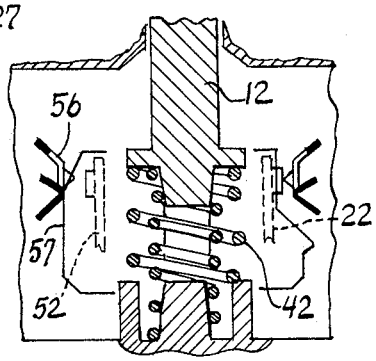
Figure 9:
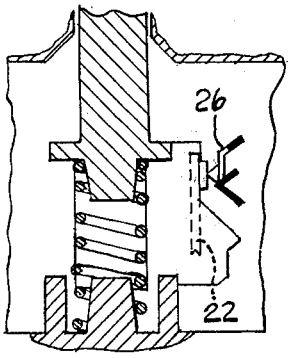

In FIGS. 7 to 9, the key switch is shown only diagramatically with its parts essential to the explanation of the function and provided with the same reference numerals as in the illustration of FIGS. 1 and 2.

On depression of the key push member 12 against the force of the coil pressure spring 17, the cam 32 of the contact tongue 26 first slides along a vertical portion of the key cam 20 until it comes to bear with a leg on the front flank of the drive nose 21. On further displacement of the push member 12, the contact tongue 26 is pivoted downwardly by the drive nose 21 until the return force of the contact tongue 26 is sufficient to allow the cam 32 to slide along the front flank of the drive nose 21 so that it pivots back upwardly past the drive nose and comes to bear freely on the contact member 22. In FIG. 9, the final position in normal actuation of the key is shown in which the contacting is no longer influenced by the key cam 20.

As soon as the driver nose 21 bears on the cam 32 and the contact tongue 26 is displaced downwardly, the force necessary for the actuation of the push member 12 increases and drops at the switching instant because the contact tongue 26 is free and the force necessary for the deflection of the contact tongue 26 is eliminated. This gives a clearly feelable pressure point.

On release of the push member 12, the latter returns to its rest position, the rear flank of the drive nose 21 bears on the lower leg of the cam 32 and displaces the latter immediately outwardly, i.e., opening the contact because the contact tongue 26 bears against the stop 37 of the guide rib 36 and cannot yield upwardly, i.e., the contact is opened immediately as the cam 32 runs onto the rear flank of the driver nose 21.

In FIGS. 3 to 6, the functional cycle is shown for an embodiment of a key switch in which a second switch blade 56 is provided. The switching function is achieved by providing an additional key cam 50 and a stationary contact 52, the key cam 50 having, however, a relatively long vertically extending slide edge 51 so that it releases the contact tongue of the blade 56 only after further depression beyond the last position of the other switch blade 26, according to FIG. 9, for engagement on the contact member 52. At this instant of the final position illustrated in FIG. 5 for normal actuation of the blade 56, the additional coil pressure spring 42 comes to bear on the bottom of the case. To obtain the continuous function, the push member 12 is depressed against the pressure of this further stiffer coil spring 42 giving a clear relatively pronounced force increase.

As already mentioned, the coil pressure spring 42 is inserted in the recess 15 of the push member 12 so that it bears under pretensioning on the support shoulders 43. By providing such pretensioning, it is ensured that a clearly detectable force change occurs on further depression when the coil pressure spring 42 comes to bear on the bottom of the case. This abrupt force change is followed by a further linear force rise on further depression which results from the addition of the spring constant of the two coil pressure springs 17 and 42.

The features of the invention make it possible to make a very stable high quality key switch extremely economically, completely automatic assembly of said switch being possible. The requirements of a noticeable pressure point immediately prior to closure of the contact and a differential path between switching point and return switching point are fulfilled in simple manner, ensuring excellent switching function by a largely abrupt closing and opening of the contacts, i.e., without play at the switching point. The closure of the contact takes place with a dropping force characteristic and is favorable as regards eliminating chatter. By the configuration of the rear flank of the driver nose, which is steeper than the locus of the contact tongue moving towards the contact member, it is ensured that the slide dish lifts off the rear flank of the driver nose and moves fleely into the contact position.

While I have illustrated and described the preferred form of construction for carrying my invention into effect, this is capable of variation and modification without departing from the spirit of the invention. I therefore do not wish to be limited to the precise details of construction as set forth, but desire to avail myself of such variations and modifications as come within the scope of the appended claims.

Having thus described my invention, what I claim as new and desire to protect by Letters Patent is:

1. A push button key switch, comprising:

at least one electrically conducting terminal;

at least one blade means for flexing in one direction to define a first switching relationship with respect to said terminal, and for flexing in another direction to define a second switching relationship with respect to said terminal; and actuator means for selectively moving longitudinally in an actuating direction to establish said first switching relationship and for selectively moving in an opposite, return direction to establish said second switching relationship;

said actuator means having cam means for engaging and pivotally flexing said blade means in the actuating direction so that the blade means resists the movement of the actuator means over a particular distance in the actuating direction, the cam means thereafter disengaging from said blade means to allow the blade means to flex in said one direction and establish the first switching relationship, the cam means having means for engaging said blade means and flexing the blade means in said other direction to establish the second switching relationship, when the actuator means moves in the return direction.

2. The switch of claim 1, wherein said cam means includes an extending nose member and said blade means includes an extending cam tab for engaging the nose member and sliding along a first portion of the member while the member moves in the actuating direction and pivotally flexes the blade means in the actuating direction, said nose member dimensioned to slidingly disengage from said cam tab and release said blade means for transverse flexing movement in said one direction, when the actuator means moves over said particular distance and the blade means pivots to a corresponding switch actuating position.

3. The switch of claim 2, wherein said nose member includes a second portion for engaging said cam tab and flexing said blade means transversely in said other direction, when the actuator means moves in said return direction.

4. The switch of claim 1, wherein said blade means includes a support portion extending parallel to the longitudinal direction of travel of the actuator means and a switching portion extending transverse to the support portion.

5. The switch of claim 4, wherein a notch is formed at a point of intersection of said support portion and said switching portion to facilitate the flexing movement of the switching portion with respect to the support portion.

6. The switch of claim 1, further including an inclined shoulder for guiding the pivotal flexing of said blade means.

7. The switch of claim 1, including a first spring for resiliently biasing said actuator means in the return direction.

8. The switch of claim 7, wherein said actuator means includes a secondary cam means and wherein the switch further includes:

a second spring concentric with and surrounding said first spring, means for maintaining the second spring in compressive tension, means for engaging the second spring to resist the movement of the actuator means in the actuating direction after the actuator means has moved at least said particular distance, a secondary conducting terminal and means for mounting the terminal stationary with respect to the actuator means, and a secondary blade means for flexing transversely with respect to the longitudinal direction of movement of the actuator means, said secondary cam means having means for flexing said secondary blade means transversely to define a first switching relationship between said secondary terminal and said secondary blade means for as long as said second spring is not engaged to resist the movement of the actuator means in the actuating direction; and said secondary cam means having means for releasing said secondary blade means after the second spring is engaged to resist the movement of the actuator means, so that the blade means transversely flexes to define a second switching relationship between said secondary terminal and said secondary blade means.

9. The switch of claim 1, further including a blocking means for engaging at least a portion of said blade means and blocking the movement of the blade means in the return direction, when the cam means engages the blade means and moves in the return direction.

10. The switch of claim 1, further including:

a housing for retaining said terminal, blade means and said actuator means, the housing having an open end;

a cover for closing the open end of the housing;

first guide rib means formed in said housing for guiding the longitudinal movement of the actuator means, the first guide rib means including an inclined shoulder for guiding the pivotal movement of the blade means; and second guide rib means formed in said cover for cooperating with the first guide rib means to direct the movement of the blade means, said second guide rib means having a stop shoulder for blocking the movement of the blade means in the return direction, when the cam means engages the blade means and moves in the return direction.

11. A push button key switch, comprising:

a switch housing having an open end;

a cover for closing the open end of the housing, said cover having an actuator aperture formed therethrough;

actuator means disposed in said housing, said actuator means having a key portion protruding through said cover;

means for resiliently supporting said actuator means at a rest position within said housing, so that the actuator means moves longitudinally downwardly from the rest position to at least one activation position when the key is pressed, and moves upwardly to return to its rest position when the key is released;

at least one electrically conducting terminal and means for mounting the terminal within said housing in stationary relation to said actuator means;

blade means disposed within the housing and having a support portion extending parallel to the longitudinal direction of travel of said actuator means and a switching portion extending transverse to the support portion;

said actuator means having cam means for engaging and pressing the switching portion of the blade means pivotally downwardly as the actuator means is pressed downwardly to said activation position, and for thereafter releasing the switching portion for transverse movement into a first switching relation with said terminal; and means for blocking the upward movement of the switching portion of said blade means as the actuator means moves upwardly toward its rest position, so that said cam means deflects said switching portion into a second switching relation with said terminal.

* * * * *

UNITED STATES PATENT AND TRADEMARK OFFICE

CERTIFICATE OF CORRECTION

PATENT NO. : 4,339,643

DATED : July 13, 1982

INVENTOR(S) : Gunter Murmann

It is certified that error appears in the above—identified patent and that said Letters Patent is hereby corrected as shown below:

At column 1, line 48, delete "DRAWING" and insert --DRAWINGS--.

At column 1, line 57, delete "diagramatic" and insert --diagrammatic--.

At column 1, line 58, delete "botton" and insert --button--.

At column 1, line 60, delete "diagramatic" and insert --diagrammatic--.

At column 1, line 61, delete "botton" and insert --button--.

UNITED STATES PATENT AND TRADEMARK OFFICE

CERTIFICATE OF CORRECTION

PATENT NO. : 4,339,643

DATED : July 13, 1982

INVENTOR(S) : Gunter Murmann

It is certified that error appears in the above—identified patent and that said Letters Patent is hereby corrected as shown below:

At column 3, line 2, delete "diagramatic" and insert --diagrammatic--.

At column 4, line 8, delete "fleely" and insert --freely--.

Signed and Sealed this

Third Day of May 1983

[SEAL]

Attest:

GERALD J. MOSSINGHOFF

Attesting Officer

Commissioner of Patents and Trademarks